United States Patent [19]

Kirilloff et al.

[11] Patent Number: 5,045,831

[45] Date of Patent: Sep. 3, 1991

[54] VERTICAL FLIGHT RESISTOR GRID

[75] Inventors: Victor V. Kirilloff, Lincoln, Nebr.; Robert Cummins; William A. Benson, both of Pittsburgh, Pa.

[73] Assignee: Mosebach Manufacturing Company, Pittsburgh, Pa.

[21] Appl. No.: 465,389

[22] Filed: Jan. 16, 1990

[51] Int. Cl.[5] ..... H01C 3/00

[52] U.S. Cl. ..... 338/280; 338/277; 338/283; 338/281

[58] Field of Search ..... 338/280, 277–295; 219/539, 542; 373/134

[56] References Cited

U.S. PATENT DOCUMENTS

| | | | |
|---|---|---|---|
| 1,569,415 | 1/1926 | Woodson | 338/290 |
| 2,721,920 | 10/1955 | Weide | 338/293 |
| 2,772,337 | 11/1956 | Du Bois | 338/280 X |
| 2,984,806 | 5/1961 | Du Bois | 338/283 |
| 3,697,923 | 10/1972 | Griffes | 338/280 |

FOREIGN PATENT DOCUMENTS 1465881 5/1969 Fed. Rep. of Germany .

*Primary Examiner*—Marvin M. Lateef

*Attorney, Agent, or Firm*—Buchanan Ingersoll; Gordon R. Harris

[57] ABSTRACT

A resistor grid suitable for dynamic braking of diesel electric locomotives includes an upright rectangular frame with top and bottom members of insulating material and a strip of resistance material fan-folded into vertical flights between the top and bottom members. Fixtures attached to the top member suspend the fan-folded strip by its top folds and fittings affixed to the bottom member tension the fan-folded strip through its bottom folds.

12 Claims, 4 Drawing Sheets

VERTICAL FLIGHT RESISTOR GRID

This invention has to do with resistor grids used for dynamic braking in diesel-electric locomotives. It is more particularly concerned with upright resistor grids comprising fan-folded strips of resistor material in which the flights between folds extend vertically in the grid.

BACKGROUND OF THE INVENTION

Diesel-electric locomotives usually incorporate dynamic braking which includes shunting one or more heat dissipating resistors across the input to the drive motors when the locomotive is to be slowed or brought to a stop. For that operation the diesel driven generator is disconnected from the drive motors, which act as generators as long as the locomotive is moving, and one or more resistors are connected to the motor terminals. The braking resistors must dissipate considerable heat and are generally cooled by a suction fan which brings in air from outside the locomotive and draws it through the resistor grids, several of which may be stacked one behind another. Resistor grids used for that purpose are shown in Kirilloff et al. U.S. Pat. No. 4,100,526, 4,651,124, and 4,847,585.

The resistor grids of those patents are all upright grids, that is, the rectangular frames are adapted to be stacked one behind another so that a current of air can be drawn horizontally and sequentially through the fan-folded resistor strips in each frame, one after another. In each of those grids, the fan-folded resistor strip is disposed so that its flights between its folds or loops run horizontally. That arrangement is widely used but it has an inherent weakness. When the resistor ribbon heats and expands, it may sag enough to make contact with the flight below it, thus shorting out a part of the resistance. To avoid that happening, conventional grids are assembled with flights of limited lengths, and may require as many as eight columns of fan-folded strips in a grid.

The resistor grid of our invention to be described hereinafter differs from the above mentioned arrangement. In our grid the fan-folded resistor strip is disposed so that its flights between folds run vertically.

SUMMARY OF THE INVENTION

The grid of our resistor is contained in an upright rectangular frame having top and bottom members of insulating material and side members of electrically conducting material. The resistance material is a flat strip, fan-folded in a single column, each upper fold being positioned from the top frame member and each lower fold being positioned from the bottom frame member. Several types of fixtures for positioning top and bottom folds from the top and bottom frame members are disclosed. The terminal ends of the resistor strip are attached to their adjoining side members respectively. A tap which connects with any desired lower fold or loop extends through a hole in the bottom member. A mounting foot is attached to the bottom frame members at each end and is connected to its adjoining side members respectively.

BEST MODE

Figure 3:
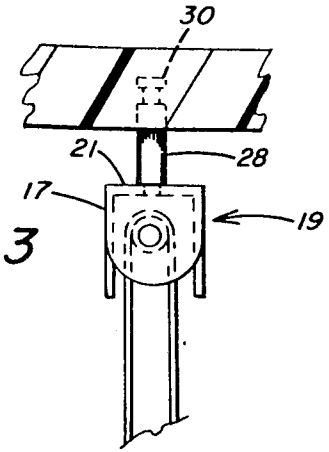
FIG. 3 is an enlarged elevation of the mounting fixture shown in FIG. 1.
Figure 2:
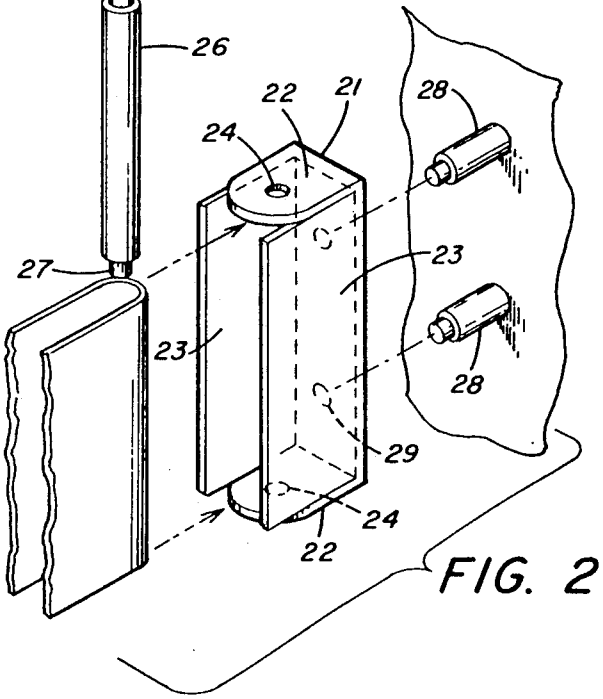
FIG. 2 is an exploded view of a fixture for positioning a fold of our resistive strip from a frame member of insulating material.
Figure 1:
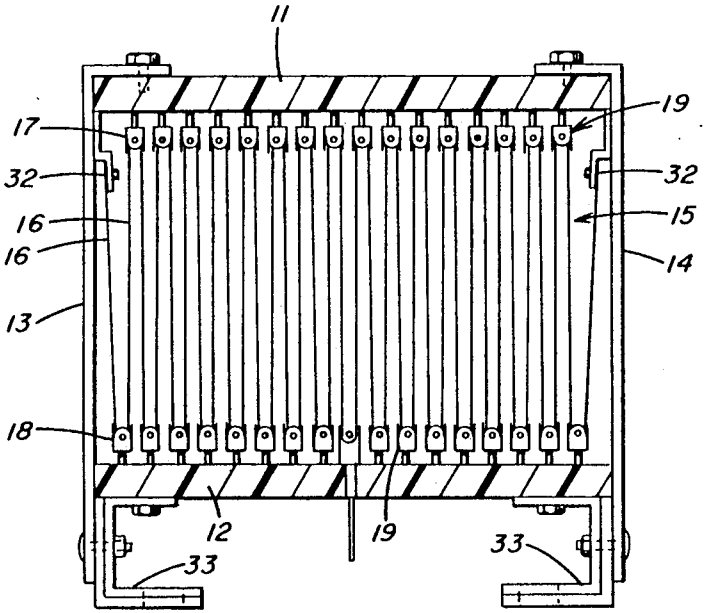
FIG. 1 is an elevation of one embodiment of our invention.

Our grid is encompassed in a frame, shown in FIG. 1, having a top member 11 of insulating material, a bottom member 12, also of insulating material, and side members 13 and 14 respectively, made of metal. Within that frame is a flat strip of resistance material 15 disposed in parallel vertical flights 16—16 between upper folds or loops 17, enlarged in FIG. 3, and lower folds or loops 18. The upper loops or folds 17 are positioned with respect to top member 11 by fixtures 19, shown in detail in FIGS. 2 and 3, and the lower loops or folds 18 are positioned with respect to bottom member 12, also by fixtures 19. Those fixtures 19, in a first embodiment, comprise a bracket, FIG. 2, having an elongated cross-piece 21 of somewhat greater length than the width of the strip 15, two end pieces 22 normal to cross-piece 21 and optionally two side pieces 23 normal to cross-piece 21 and to end pieces 22, the spacing between pieces 23 being sufficient to enclose a fold 17. End pieces 22 have aligned holes 24 therein. A cylindrical pin 26 dimensioned to fit inside end pieces 22—22 and side pieces 23—23 has projecting cylindrical ends 27—27 dimensioned to fit holes 24—24. Ends 27—27 may telescope in cavities in pin 26 against springs, not shown, which urge them outwardly. Fixtures 19 are attached to top member 11 by standoffs 28 affixed to cross-piece 21, such as by welding or staking in holes 29 drilled in cross-piece 21, and anchored at their other ends 30 in top member 11.

The resistance strip 15 is folded into loops 17 the required distance apart and those loops are introduced successively into successive fixtures 19, as above described, by sliding pins 26 through the loop and inserting the pin ends 27—27 into holes 24—24 in end pieces 22.

Fixtures 19 in bottom member 12 are identical with those in the top member above described, and loops 18 in strip 15, folded the required distance apart, are introduced into successive fittings 19 in the way above set out. The terminal ends 32—32 of the strip 15 are attached to side members 13 and 14 respectively. Metal angles 33 may be attached to the ends of side members 13 and 14 projecting below bottom member 12 to form supporting feet for the grid, as well as connections to bus bars or other grids if desired.

Figure 4:
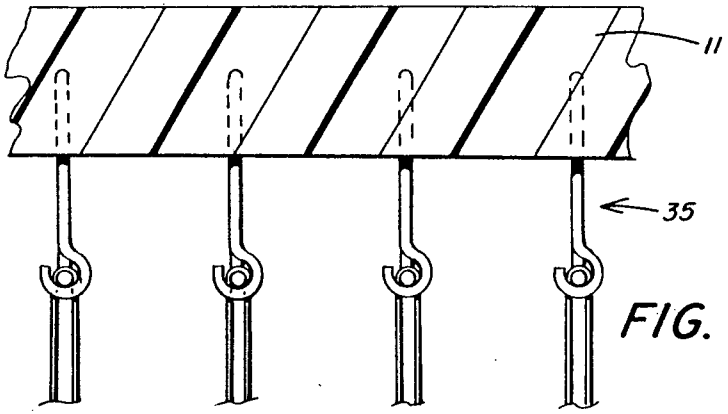
FIG. 4 is an elevation of a spring clip mounting fixture for a second embodiment of our invention.
Figure 5:
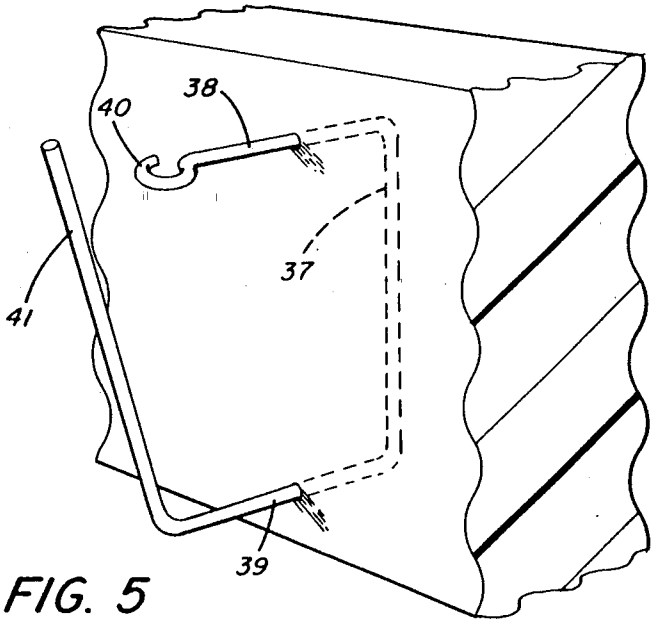
FIG. 5 is a fragmentary isometric view of the spring clip of FIG. 4 in its open position.

A second embodiment of fixtures for mounting fan-folded resistance strip 15 in our grid structure is shown in FIGS. 4 and 5. Top member 11, FIG. 4, carries successively positioned spring clips 35, preferably made of round wire bent as shown in FIG. 5. If the top and bottom members 11 and 12 are a molded copolymer, which we prefer to use, clips 35 can be molded in place therein. The clips are formed with a crossbar 37, legs 38 and 39 normal to crossbar 37 at either end, an open hook 40 at the outer end of leg 38 and a spring bar 41 extending inwardly from the outer end of leg 39 but with its free end some distance from hook 40 so that a loop or fold 17 or 18 of the resistor strip can be slipped over spring bar 41. That bar is then bent toward top member 11 and forced into hook 40. The bottom member 12 is fitted with the same type of fixture 35 and the lower folds 18 of the resistor strip 15 are held in place by those fixtures in the same way as is above described.

Figure 6:
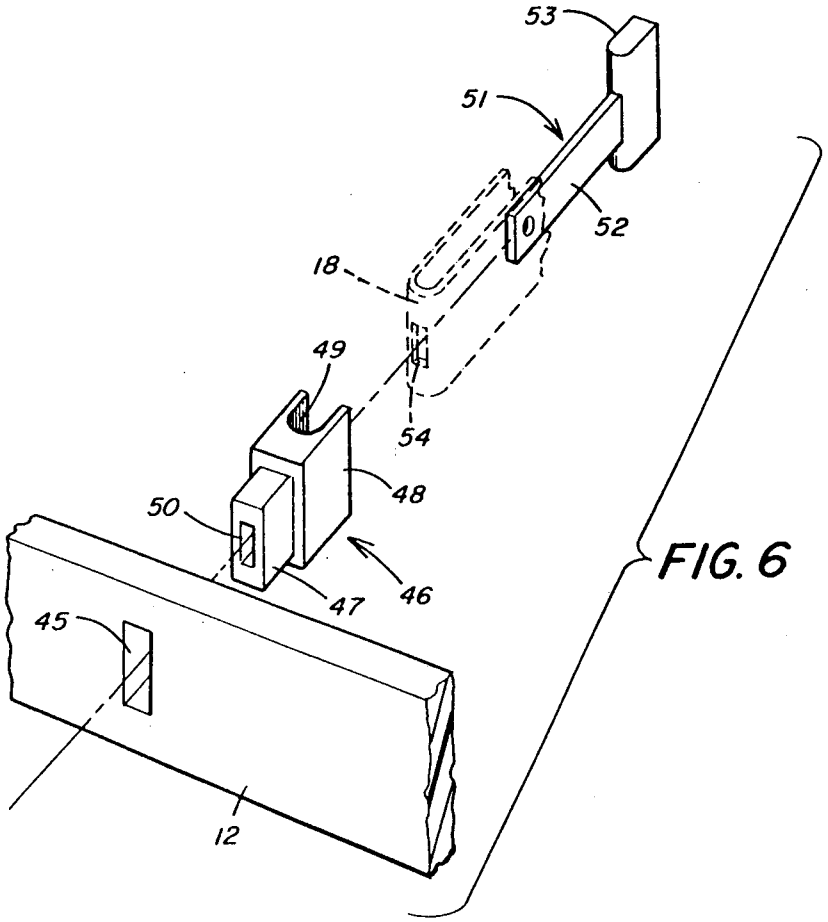
FIG. 6 is an exploded view of the tap shown in FIG. 1.

If a tap on the resistor element 15 is desired, such a tap may be fitted as is shown in the exploded view of FIG. 6. A hole 45 of any shape other than round is formed in bottom member 12. Our fitting comprises a fixed element 46 having a stem 47 which will fit into the hole 45 without rotating therein, and a head 48 larger than hole 45 with a cross-groove or channel 49 in its upper end into which a fold or loop 18 can fit and an opening 50 from the bottom of that channel through stem 47. That opening can also be any shape but round. Our fitting also includes a movable element 51 which comprises a tongue 52 which will pass through opening 50 and stem 47 and extend beyond the lower face of member 12. The upper end of tongue 52 has a head 53 which is shaped to fit inside a fold 18. Fold 18 has an opening 54 cut in its lowermost surface through which tongue 52 can pass. When element 51 is in place, its head 53 tends to force fold 18 into channel 49 in head 48 so as to make electrical contact therewith.

Figure 8:
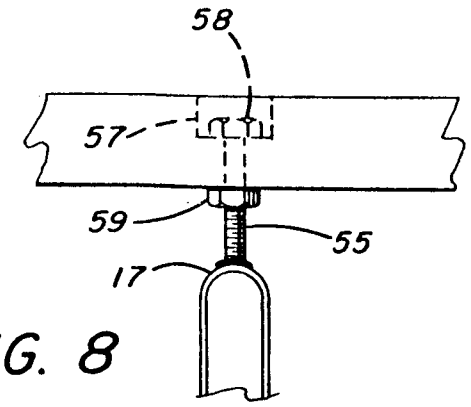
FIG. 8 is a detail of a modified fixture as shown in FIG. 7.
Figure 9:
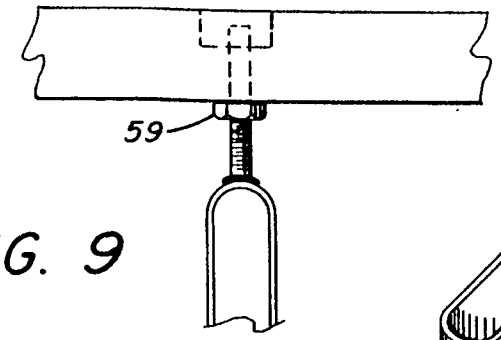
FIG. 9 is a detail of a second modified fixture as shown in FIG. 7.
Figure 10:
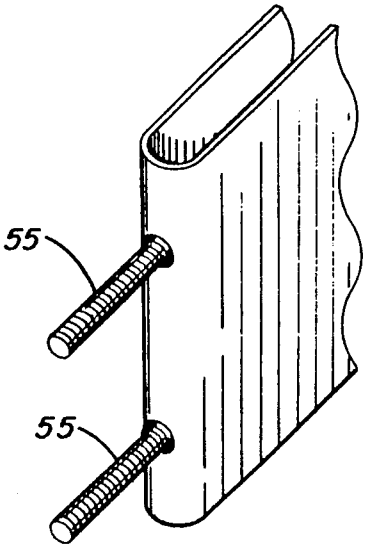
FIG. 10 is a detail of a portion of the embodiment of FIG. 7.
Figure 7:
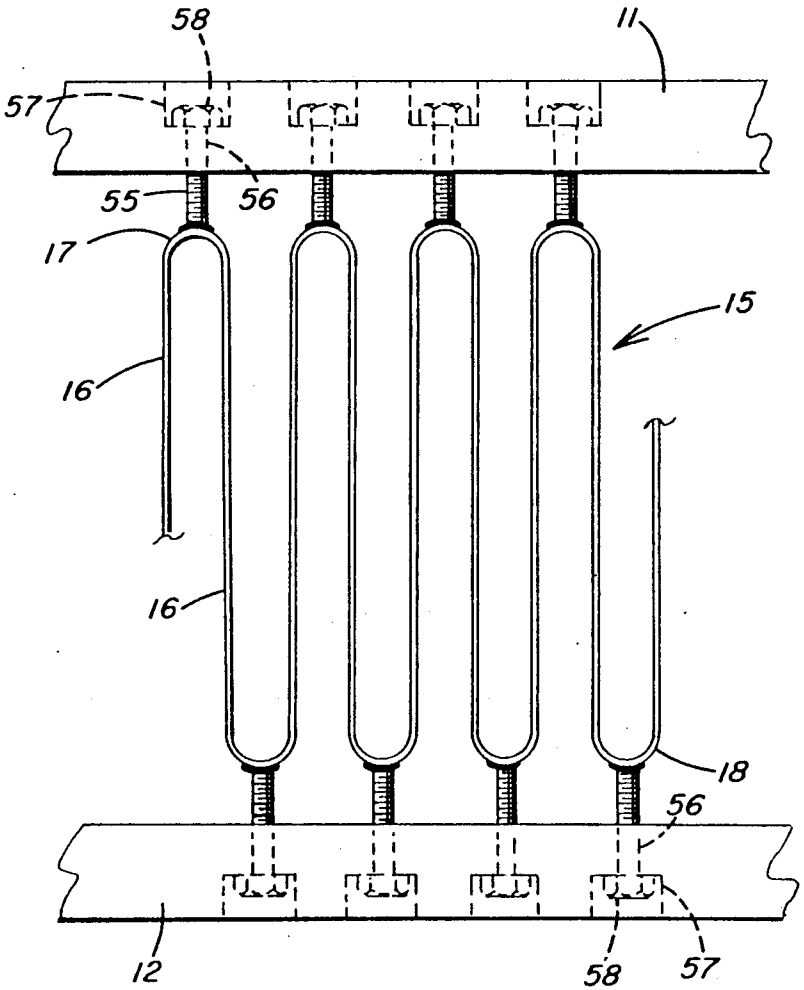
FIG. 7 is a fragmentary elevation of a third embodiment of our invention.

A third embodiment of a fixture for mounting a fan-folded resistor strip 15 in our grid structure is shown in FIGS. 7 through 10. Each upper fold or loop 17 of resistor strip 15 has one or more threaded studs 55 welded thereto, as does each lower fold or loop 18. Two such studs 55 are shown in FIG. 10. Top member 11 has holes 56 formed therein aligned with studs 55 and bottom member 12 has like holes 56 formed therein. The outermost portions of holes 56 are enlarged, as in 57, to accommodate a nut 58 therein. The nuts are screwed down to tension the fan-folded strip 55. FIG. 8 illustrates the above-described fixture with an additional nut, a stop nut, 59 on the underside of top member 11 or the upper side of bottom member 12. FIG. 9 illustrates a fixture with stop nut 59 only, which may be adequate in grids with heavy gauge resistor strips.

Figure 11:
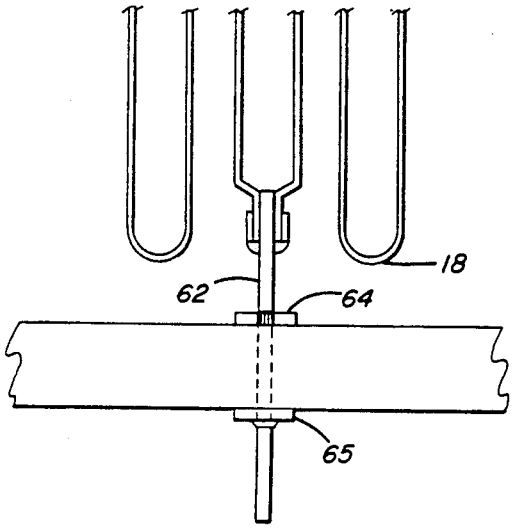
FIG. 11 is a detail elevation of a second embodiment of a tap for our invention.
Figure 12:
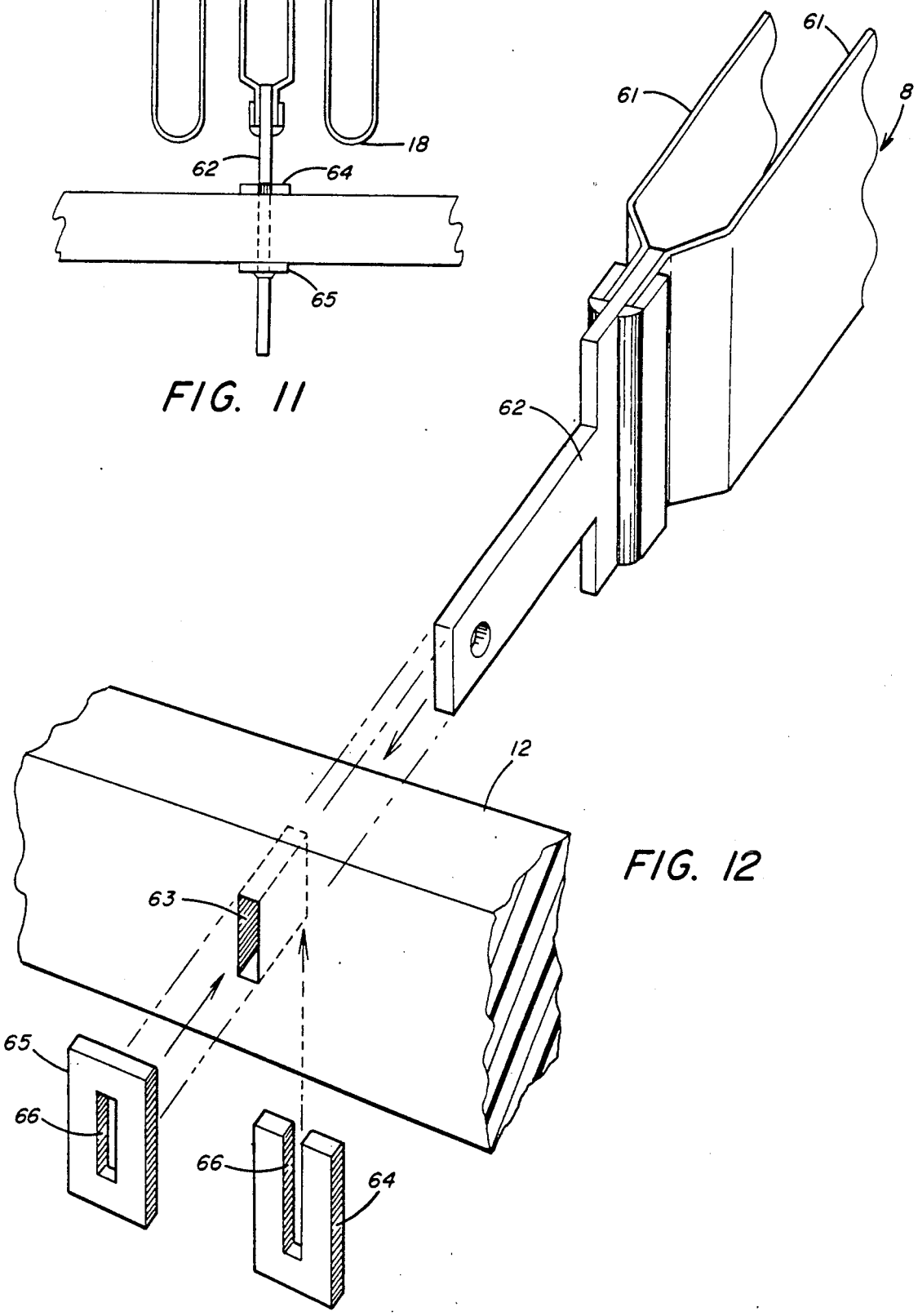
FIG. 12 is an exploded view of the tap of FIG. 11.

A second embodiment of a tap on resistor element 15 is shown in FIGS. 11 and 12. A lower fold or loop 18 is cut transversely at its bottom end and its two cut ends 61—61 are bent outwardly parallel to each other but offset to receive between them a tongue 62 which extends away from loop 18 and forms the tap. The two cut ends 61—61 are welded to the end of tongue 62 between them. As before, a hole 63 is cut in bottom panel 12 through which tongue 62 will pass. Tongue 62 is held in place in hole 63 by an inside holder 64 which is a flat piece of metal with a slot 66 extending inwardly from one end so that it can be slipped over tongue 62 along the upper face of bottom panel 11 and an outside holder 65, which is also a flat piece of metal with a slot 66 cut therein, through which tongue 62 will pass. After those holders are in place, they are welded to tongue 62.

We claim:

1. In an upright resistor grid having a top member, two side members, a bottom member, and a fan-folded resistance element supported therein, the improvement comprising said top and bottom members being insulating members, said side members being conducting members, said resistance element being a flat strip, and including mounting fittings carried by said top member for suspending said fan-folded strip by the folds of said strip, and mounting fittings for said fan-folded strip carried by said bottom member for maintaining tension in said flat strip.

2. The resistor grid of claim 1 in which the terminal ends of said fan-folded strip are attached to their adjoining side members, respectively.

3. The resistor grid of claim 1 including a support element at each end of said bottom member adapted to support said resistor grid in an upright position.

4. The resistor grid of claim 1 in which said mounting fittings comprise a crosspiece affixed to said top member below it, a crosspiece affixed to said bottom member above it, and pins supported at both ends by said crosspiece, each pin passing through a fold of said fan-folded strip.

5. The resistor grid of claim 4 in which said crosspieces are spaced from said members by standoffs.

6. The resistor grid of claim 4 in which said pins have smaller diameter ends fitting in holes in said crosspieces.

7. The resistor grid of claim 6 in which said smaller diameter ends are axially movable in said pins and including means for urging said ends outwardly.

8. The resistor grid of claim 1 in which said fittings comprise a spring shaft crossbar affixed to at least one of said top or bottom members and a hook affixed to said one member with which the free end of said crossbar can be engaged so as to pass through a fold of said fan-folded resistor strip.

9. The resistor grid of claim 1 including a tap extending through said bottom member having an upper end shaped to fit closely around a fold of said fan-folded resistor strip, a longitudinal hole therethrough, and a tongue which passes through said hole having a head larger than said hole fitting inside said fold.

10. The resistor grid of claim 1 in which said fittings comprise studs attached to said folds, holes mating with said studs in said top and bottom members, and means for preventing withdrawal of said studs from said holes after insertion therein.

11. The resistor grid of claim 10 in which said studs are threaded and said means for preventing withdrawal thereof are nuts.

12. The resistor grid of claim 1, including a tap extending through said bottom member, having an upper end welded to a fold of said fan-folded resistor strip, an inside and an outside holder, each comprising a flat piece of metal with a slot therethrough, through which said tap extends, the inside holder being adjacent the upper face of said bottom member and the outside holder being adjacent the lower face of said bottom member, said slot in said inside holder extending through an end thereof so that said inside holder can be slipped over said tap while said tap is in place; both inside and outside holders being welded to said tap.

* * * * *